United States Patent [19]

Anderson

[11] Patent Number: 5,027,896

[45] Date of Patent: Jul. 2, 1991

[54] METHOD FOR IN-SITU RECOVERY OF ENERGY RAW MATERIAL BY THE INTRODUCTION OF A WATER/OXYGEN SLURRY

[76] Inventor: Leonard M. Anderson, P.O. Box 1529, New York, N.Y. 10116-1529

[21] Appl. No.: 496,674

[22] Filed: Mar. 21, 1990

[51] Int. Cl.[5] ..... E21B 43/243; E21B 47/00

[52] U.S. Cl. ..... 166/251; 166/261

[58] Field of Search ..... 166/261, 251, 256, 250

[56] References Cited

U.S. PATENT DOCUMENTS

| | | | |
|---|---|---|---|
| 2,803,305 | 8/1957 | Behning et al. | 166/251 |
| 4,185,548 | 1/1980 | Grisburgh et al. | 166/251 |
| 4,252,191 | 2/1981 | Pusch et al. | 166/261 |
| 4,495,993 | 1/1985 | Andersen | 166/261 |
| 4,498,537 | 2/1985 | Cook | 166/261 X |
| 4,508,170 | 4/1985 | Littmann | 166/261 X |
| 4,577,690 | 3/1986 | Medlin | 166/251 |
| 4,778,010 | 10/1988 | Knecht et al. | 166/261 |

*Primary Examiner*—Stephen J. Novosad

*Attorney, Agent, or Firm*—Darby & Darby

[57] ABSTRACT

The present invention relates to methods of recovering energy materials, such as oil, shale oil or hydrocarbon gas, by providing limited combustion of these energy materials within an underground energy material reservoir and, consequently, thinning and mobilizing the energy materials such that their recovery is increased. The methods involve the injection into a borehole of an water/oxygen slurry which releases oxygen gas as it flows into the reservoir and recovering, at a later time following in-situ combustion and/or reaction, an improved energy material yield from said borehole or adjacent borehole.

17 Claims, 1 Drawing Sheet

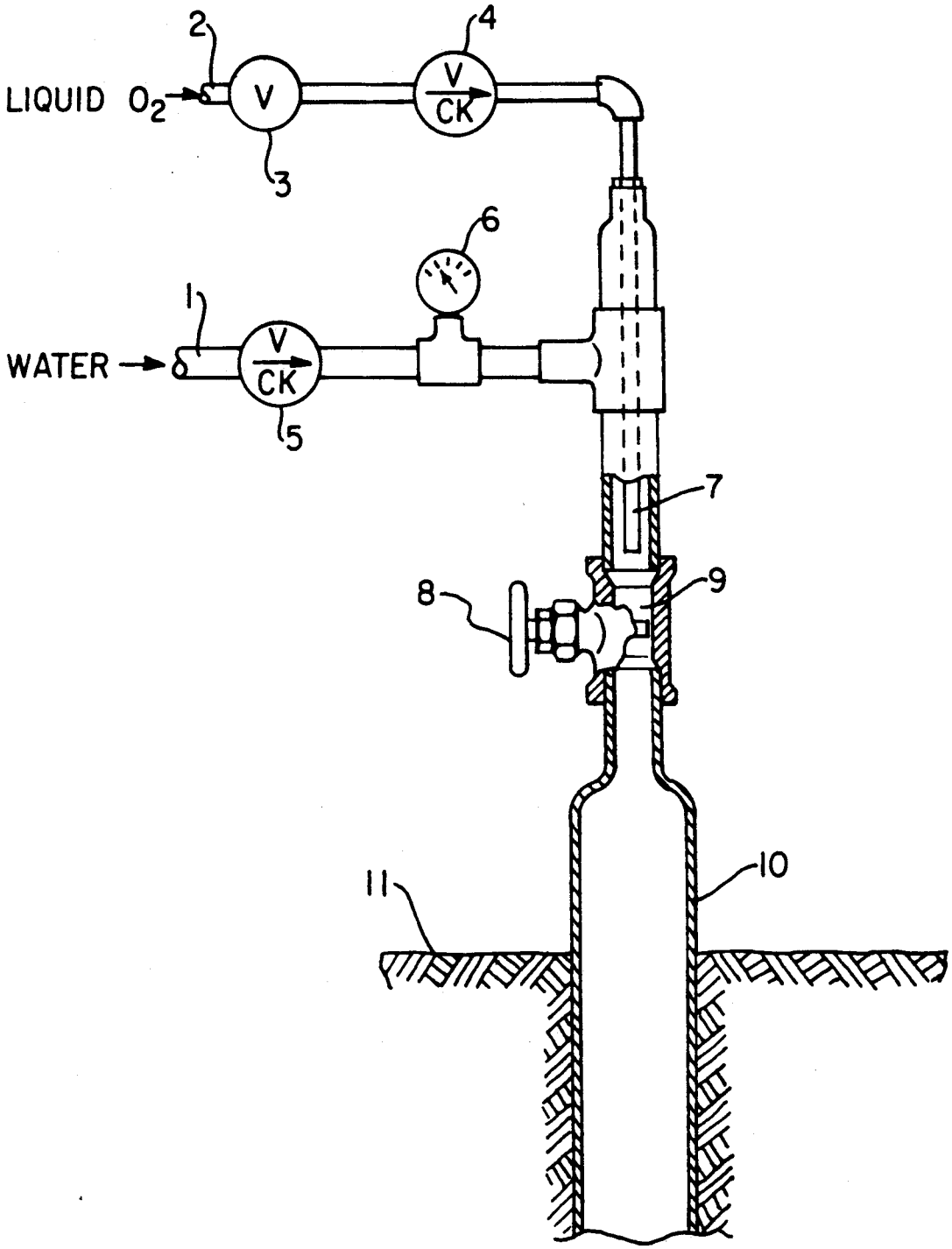
LIQUID $O_2$
WATER
V
V
CK
V
CK
1
2
3
4
5
6
7
8
9
10
11

METHOD FOR IN-SITU RECOVERY OF ENERGY RAW MATERIAL BY THE INTRODUCTION OF A WATER/OXYGEN SLURRY

BACKGROUND OF THE INVENTION

This invention relates to a method for recovering energy raw materials from a subterranean formation by the introduction of water/oxygen slurries into the formation.

The techniques used in recovering raw energy materials from subterranean formations varies depending on such factors as the form of energy raw material, geology, financial resources, etc. In oil production, the most common approach uses a "primary recovery" phase of 3 to 5 years after drilling a well. In primary recovery no effort is made to increase production beyond the energy raw material that is readily extracted due to pumping or pressure within the formation. Secondary recovery generally involves mobilizing additional oil by pumping water through the formation. Primary and secondary recovery leave large amounts of oil in the ground (approximately 65% to 80%).

Tertiary recovery is done by several methods, such as in-situ combustion and thermal displacement. The invention of the in-situ combustion method for petroleum recovery by F.A. Howard in 1923, did not yield substantial recoveries until recently due to control problems and the unpredictability of the method. This in-situ combustion method produces sufficient heat within a petroleum reservoir which, by means of partial combustion of the oil residues in the petroleum reservoir, enable the recovery of the remaining oil. The amount of combustion heat released in a reaction between oxygen and organic fuels is on average 3,000 kcal. per Kg oxygen. The important processes contributing to petroleum displacement are viscosity reduction by means of heat, distillation and cracking (i.e., "thinning") and extraction of the oil by means of miscible products. This is similar to the method specified in U.S. Pat. No. 3,026,935.

The use of oxygen gas to create an in situ burn has drawbacks. Its reactivity in higher purities can cause fires and explosions. The handling of compressed oxygen flowing through piping systems requires special precautions which have been developed. Such precautions include the use of large inner surfaces in relation to volume, appropriate geometry to prevent local temperature peaks, and lower purity oxygen content (because oxygen at 95% purity can ignite steel, though the burn is not self-sustaining). High purity oxygen is generally corrosive. It is difficult to control the combustion obtained when oxygen gas is injected into a raw energy-bearing formation. This technique has, on occasion, led to fire damage not just at the injection well, but at separate production wells. This leads to a need for obtaining the benefits of high partial pressures of oxygen for in-situ combustion without the foregoing drawbacks.

The reactivity of and associated danger of oxygen in a cryogenic liquid state is far less. There are requirements due to the cryogenic temperatures. This is well understood and has been reduced to practice for decades by using equipment made of nickel alloys, copper alloys, aluminum, and certain design features. Within a petroleum formation, channeling and vaporization of the cryogenic fluid fractures the formation. The gaseous product of this volatilization causes a miscible and/or non-miscible displacement of the oil driving it from an injection borehole in a flood pattern arrangement.

U.S. Pat. No. 4,495,993 provides a method for more safely injecting oxygen into boreholes by using such a cryogenic oxygen-containing mixture.

According to U.S. Pat. No. 4,042,026, the most dangerous point along the oxygen flow path is the borehole. This danger could be lessened or eliminated by several means. The very nature of a cryogenic liquid containing oxygen lessens such danger. Also, a fluid with a lower concentration of oxygen or no oxygen may be injected as a pretreatment. There are many gases and liquids which may be injected into the borehole and which, through reaction or displacement, lessen such danger. Another means would be through the limited injection of an oxygen containing gas, causing a limited in-situ burn in the borehole and adjacent energy raw material containing formation.

The cryogenic liquid method of oxygen injection disclosed in U.S. Pat. No. 4,495,993 has gained some acceptance, however, problems have been encountered. The handling of such cryogenic liquids requires special materials which retain their strength at cryogenic temperatures. Such materials are not commonly used in the oil fields. More specifically, the materials at the wellhead or in the well casing are not usually tolerant of ultra-cold temperatures (e.g., the b.p. for oxygen is −182.79° C). Most common forms of steel, for instance, become brittle at cryogenic temperatures. Thus, the method requires extensive replacement or removal of materials at the wellhead and the borehole. The need for these modifications and for specialized equipment makes the cryogenic method expensive and thereby less attractive to the small operator.

The cryogenic method also has less utility in energy-bearing reservoirs that have been water flooded. The majority of U.S. oil reservoirs, including actively producing reservoirs, are water flooded. The injection of cryogenic liquids is hampered in such reservoirs by ice formation within the oil-bearing subterranean formation with consequent blockage of further injection.

It is an object of the present invention to provide methods to safely inject oxygen into energy-bearing reservoirs without overburdensome modifications at the wellhead or in the borehole and without interference due to water flooding.

It is a further object of the present invention to provide seismic events within an energy-bearing geologic formation. The size and distribution of the seismic event being indicative of the richness and distribution of the energy resource.

These and other objects of the present invention will be apparent to those of ordinary skill in the art in light of the present description and appended claims.

SUMMARY OF THE INVENTION

It has now been unexpectedly discovered that a slurry of water and oxygen-containing cryogenic or oxygen-containing gas liquid can be injected into an energy-bearing reservoir borehole to provide in-situ burning of the underground energy resource and a consequent increase in recovery of the energy resource either at said borehole or at a neighboring borehole.

BRIEF DESCRIPTION OF THE DRAWINGS

FIG. 1 shows an apparatus that can be used for mixing and injecting into a borehole the oxygen/water slurries of the present invention.

DETAILED DESCRIPTION OF THE INVENTION

All literature citations, patents and patent publications found herein are incorporated by reference.

As used herein, "water/oxygen slurry" will mean a slurry resulting from mixing water and either a cryogenic liquid containing oxygen or a gas containing oxygen. This water/oxygen slurry will be substantially fluid in nature but may contain ice to form a slush. The temperature of such an water/oxygen slurry is expected to be about 0° C. to about −20° C. but may be less because of supercooling due to turbulent flow or from boiling of gases derived from cryogenic liquids, and because of freezing point depression due to dissolved salt, gas or cryogenic liquids.

The term "pay zone" refers to an energy-bearing subterranean formation, specifically the depth range where a borehole contacts energy raw material.

As used herein, the expression "energy raw material" shall mean oil or gas hydrocarbons found in a geologic formation. "Energy-bearing formation" or "energy-bearing reservoir" shall refer to any geologic formation, including coal, oil shale or heavy oil-bearing formation, containing energy raw material.

There are two basic modes of operation. First, where all introduction of water/oxygen slurry is through one borehole, and all production of energy raw materials is from the same borehole. The second is where water-/oxygen slurry is through one or more boreholes (establishing a mobile front or flood) driving the desired energy raw material to borehole(s) different from the borehole(s) where gas and liquid were introduced. A pretreatment can be applied by injecting into the reservoir a fluid material which will prevent premature combustion near the borehole.

One way this pretreatment may be done is to inject a reduced amount of water/oxygen slurry into the formation; cap the borehole; and allow time to achieve a limited volume in-situ combustion and permit the borehole and the formation adjacent to it to cool. The combustion products are vented and the process repeated until the desired clearing of combustibles is achieved. Another means to achieve this would be to introduce an water/oxygen slurry and/or inert gas and/or liquid such as water into the borehole and adjoining subterranean formation to prevent the undesired consequences noted upon subsequent introduction of a large amount of water/oxygen slurry.

In one embodiment, the water/oxygen slurry is introduced into the borehole which is to be the production borehole after the in-situ burn treatment. The introduction of the water/oxygen slurry is done through the tubular packing arrangement noted above or other suitable means. The water/oxygen slurry can have the percentage of oxygen varied during its introduction to achieve maximum benefit.

The low fluidity of the water/oxygen slurry (it is cold, slushy and resists flow) allows greater control of the insitu burn than that attainable with an oxygen containing gas or with cryogenic oxygen. Water/oxygen slurry allows more efficient use of oxygen due to the tendency of the water/oxygen slurry to flow outward and downward. Such flow distributes the volatilized gaseous oxygen differently within the subterranean formation. For instance, in a multiple borehole energy-bearing reservoir, the water/oxygen slurry when injected at one borehole can be expected to flow into the reservoir and approach the other boreholes (production boreholes) via disperse and indirect flow patterns. In contrast, oxygen gas has no tendency to sink into the formation and has a tendency to find the shortest path to a low pressure zone and escape through the higher parts of the formation (i.e. the cap rock). In a highly fractured formation, this path can be especially short and gas will pass quickly and ineffectively through the formation. Cryogenic liquids are free-flowing (very low viscosity, e.g. liquid oxygen has a viscosity of 0.189 cp) and their dispersal patterns in an energy-bearing formation are difficult to anticipate.

After the initial introduction of the water/oxygen slurry, a limited injection of a liquid or a gas can be used to prevent the in-situ combustion and/or chemical reaction from damaging the borehole and/or its contents, or to move the water/oxygen slurry further into the energy-bearing formation. This can be repeated yielding concentric patterns around the borehole of the water-/oxygen slurry, and of other liquid and gas mobilizers. After the introduction(s) of the water/oxygen slurry is complete, and the subsequent injection of fluids to preserve the integrity of the borehole and its contents, a period of time is allowed to pass without flow through the borehole.

Within the subterranean formation a beneficial effect of the water/oxygen slurry occurs. As the water/oxygen slurry flows into the oil-bearing formation, its temperature increases and oxygen gas is released. The resulting oxygen containing gas, forms pockets which, upon reaching the required temperature to pressure ratio for the oxygen and energy raw material in the borehole, combusts. The combustion would be of the slow flame and detonation form. The detonation would be of limited volume as occurs in an internal combustion engine. The low molecular weight oxides formed by this combustion are oil soluble and can, consequently, swell oil. This in turn can stress the rock bearing the oil, possibly fracturing it and making it more susceptible to fracturing due to shock waves generated by the above described combustion.

This kind of fracturing is localized and of small scale. It is expected that such fracturing can disrupt the channels formed by larger stresses. This in turn is expected to cause recovery-enhancing fluids, such as water or steam, to flow through the formation more uniformly, mobilizing energy raw material that previously was out of the flow pattern. Channel disruption of this kind results in an increase in injection pressure.

By increasing the amount of oxygen injected, water-/oxygen slurry can be used to cause greater stress in the formation and thereby to create drainage (i.e. to fracture the formation). In this application, the water/oxygen slurry can contain sand, which serves to prop open any fractures formed (see Baker, *Oil and Gas: The Production Story*, Petroleum Extension Service, Austin, Tex., 1983).

The chemical products of this combustion reaction-cracking process would be different from that achievable with an oxygen containing gas in that the localized pressure and temperature would, to an extent, be determined by the oxygen plus water volatilization from the slurry and the detonation achieved. These chemical products, including carbon dioxide, water and unreactive volatilized portions of the water/oxygen slurry, would, due to the heat of the in-situ combustion and lower density, tend to rise and move horizontally within the energy raw material bearing subterranean formation. This displacing flood would thermally and through miscibility displace and/or mobilize liquid and/or gaseous hydrocarbons. The different chemical products and the disperse flow pattern of the water/oxygen slurry would tend to make this flood more efficient. The phenomena noted would occur simultaneously in close proximity due to the pocketing phenomena noted above.

The time required for this to occur would be in the order of days and be determined by the exact formation and recovery program. Sufficient time should be allowed to provide for fracturing, thermal, shock and displacement mechanisms to reach optimum levels. Approximately 10 to 20 days would be reasonable with experience and/or downhole monitoring determining the exact time. The production phase would be similar to in-situ combustion techniques (see Baker, *Oil and Gas: The Production Story*, Petroleum Extension Service, Austin, Tex., 1983).

The second major embodiment would be to introduce water/oxygen slurry into one or more borehole(s) and remove the desired energy raw material from other borehole(s). The surprising mechanisms noted would be similar to the one borehole embodiment with one direction frontal flow toward the borehole from which the desired energy raw material is to be removed. The production may utilize inert gases or fluids to mobilize energy raw material.

The gas injected to mobilize the oil would normally be air, or "inert gas" generated by combustion of hydrocarbons, carbon dioxide or natural gas. The mobilizing liquid would normally be water, but could be liquid carbon dioxide.

A standard reference (*Handbook of Chemistry and Physics* . 53rd edition, CRC Press, Cleveland, Ohio, 1972) lists the liquid oxygen solubility in cold water as 3.2 to 4.9 ml per 100 ml water. However, the water oxygen/slurry of the present invention is not an equilibrium solution. In many cases, it is not a solution at all but better described as a suspension. In a preferred embodiment, the ratio (v/v) of water to cryogenic oxygen is between about 10:1 and about 200:1. A ratio of 18:1 is particularly preferred.

At 20° C., the solubility of gaseous oxygen in water is 1 volume in 32 (Merck Index, 11th edition, Merck & Co., Rahway, N.J., 1989). However, the elevated pressure used to inject into an energy reservoir allows for more oxygen to dissolve. Furthermore, this mixture may also be a suspension rather than a solution. The mixture useful in the present invention is about 3% to about 60% (v/v) oxygen gas.

Cryogenic or gaseous oxygen of 90% purity is preferred; 95% purity is more preferred.

After initial injection of an oxygen slurry into a borehole, a gelling agent may be introduced into the slurry and injection continued. Such a slurry is even more resistant to flow, especially at low temperature, and will plug the injection borehole to prevent premature backflow of gas or liquid. Gelling agents useful for this purpose are carboxy vinyl polymer such as polyvinyl acetate (Rhienhold, White Plains, N.Y.), water-swellable starch, water swellable gum such as Carraghenan (FMC Corp., New York, N.Y.), carboxymethylcellulose (Aqualon Co., Willmington, Del.), water-swellable polymers, etc. The preferred concentration of gelling agent is about 0.1% to about 2% (w/v).

Gelling agent may also be added to the slurry throughout the injection. This can be useful in circumstances where it is desirable to change the flow characteristics of the slurry. For instance, when injecting into highly fractured or sandy raw energy-bearing formations.

In another embodiment, oxygen-containing fluid (i.e., oxygen gas, cryogenic liquid containing oxygen or water/oxygen slurry) is injected into the borehole and seismic monitoring equipment is used to record the magnitude and temporal distribution of the seismic events associated with the resulting combustion. These seismic signals are indicative of the energy richness and the energy distribution near the borehole. ("Energy richness," as used herein, refers to the concentration and combustibility of energy raw materials within an energy-bearing formation.) The process can, optionally, be repeated at additional boreholes in the reservoir. As outlined above, the water/oxygen slurry injections can be varied in size and interspersed with injections of inert fluids. The correlation of seismic events and oxygen injection protocols is expected to provide additional information on the characteristics of the underground energy-bearing reservoir. Seismic analysis of this sort is expected to help define optimal locations for drilling new boreholes and to aid in the economic evaluation of the energy-bearing reservoir.

Seismology is well developed in the art of energy exploration and recovery (see Baker, *The Production Story*, supra). Traditionally, a variety of techniques are used to produce low frequency sound at the surface (heavy vibrators, air guns, explosions, etc.). The characteristics of the underlying geology are analyzed on the basis of the sound reflective geologic surfaces defined by the returning seismic signal. In contrast, the seismic method of this embodiment produces signals within an energy-bearing formation.

The invention is described below with a specific working example which is intended to illustrate the invention without limiting the scope thereof.

EXAMPLE 1

An oxygen slurry was injected into an oil-bearing formation of consolidated sand with some limestone at a depth of 1900 ft. 5430 pounds of liquid oxygen and 226 pounds of oxygen gas were injected in approximate 18:1 dilution with water. At about 7 days post injection, the inject pressure had increased from a range of 0–230 psi to a range of 200–430 psi, indicative of a reduction in channeling within the formation. Production has increased at neighboring boreholes.

EXAMPLE 2

An water/oxygen slurry was injected into a waterflooded energy-bearing reservoir having six boreholes. The pay zone was found in a layer of unconsolidated sand at a depth of 520 feet. After injection of water/oxygen slurry (comprising 1030 pounds liquid oxygen and 380 pounds oxygen gas in a water slurry), oil recovery at the adjacent five wells increased 20% over a 40-day period. After in situ combustion, the pressure required for injection at the injection borehole decreased from 200 to 150 p.s.i. and returned to 200 p.s.i. after 20 days. Liquid chromatographic analysis of the hydrocarbon recovered showed an absence of olefins and a relative decrease in volatile hydrocarbons. These characteristics are consistent with in-situ combustion.

For this embodiment of the invention, an injection apparatus similar to the that in FIG. 1 was used. Therein: 1. The water inlet; 2. The liquid oxygen inlet;

3. Quick acting valve; 4. Non-return valve; 5. Non-return valve; 6. Pressure gauge; 7. Inner pipe; 8. Master Valve; 9. Mixing chamber; 10. Well bore casing; and 11. Ground.

What is claimed is:

1. A method for recovering energy raw materials such as oil and gas from a subterranean formation penetrated by a borehole, comprising the steps of:

introducing into said borehole a fluid material which will prevent premature reaction near said borehole of an water/oxygen slurry to be subsequently introduced;

thereafter continuously introducing a water/oxygen slurry into said borehole so that said water/oxygen slurry contacts the adjacent subterranean formation, said slurry comprising water and oxygen in a suspension of ice and liquid having a temperature of about 0° C. or less;

closing the borehole and permitting the oxygen to vaporize, the amount of oxygen and its pressure being sufficient to enable a limited combustion of the available energy raw materials; and subsequently recovering energy raw materials from said borehole or another borehole that contacts said subterranean formation.

2. A method according to claim 1, wherein an additional injection of said fluid material follows said injection of water/oxygen slurry and precedes said closing of borehole.

3. A method according to claim 1, wherein said water/oxygen slurry consists of about 200:1 to about 10:1 volumes of water to volumes of liquid oxygen.

4. A method according to claim 3, wherein said water/oxygen slurry consists of 18 volumes water for each volume of said liquid oxygen.

5. A method according to claim 1, wherein said water/oxygen slurry comprises about 3% (v/v) to about 60% (v/v) oxygen gas.

6. The method according to claim 3, wherein said slurry further comprises a gelling agent selected from the group consisting of carboxy vinyl polymer, water-swellable starch, water-swellable gum, water-swellable polymer, carboxymethylcellulose, and mixtures thereof.

7. A method according to claim 1, wherein said fluid material comprises a water/oxygen slurry, the amount of oxygen being sufficient so that an in-situ combustion of limited scale will occur within an area of said borehole to rid said area of combustibles.

8. A method according to claim 1, wherein said fluid material comprises an inert gas.

9. A method according to claim 8 wherein said inert gas is selected from the group consisting of nitrogen, carbon dioxide and gaseous combustion products of hydrocarbons.

10. A method according to claim 1 wherein said fluid material further includes a liquid, said liquid selected from the group consisting of water, liquid carbon dioxide, and mixtures thereof.

11. A method according to claim 1 wherein energy raw materials are removed from the borehole into which the water/oxygen slurry is introduced.

12. A method according to claim 1 wherein energy raw materials are removed from a borehole other than the borehole into which said water/oxygen slurry is introduced.

13. A method according to claim 1, wherein the oxygen content of the water/oxygen slurry is varied during the introduction thereof.

14. A method for analyzing the energy richness and distribution within a subterranean energy-bearing formation comprising:

introducing into a borehole penetrating said formation an oxygen-containing gas, an oxygen-containing cryogenic liquid, or an water/oxygen slurry, and recording at one or more locations any subsequent seismic activity resulting from said injection, the size and distribution the seismic event reflecting the energy richness and energy distribution of said formation.

15. The method of claim 1 further comprising, subsequent to said slurry introduction step and prior to said closing step, the step of introducing said water/oxygen slurry, wherein said slurry further comprises a gelling agent selected from the group consisting of carboxyl vinyl polymer, water-swellable starch, water swellable gum, water-swellable polymer, carboxymethyl cellulose and mixtures thereof.

16. A method for analyzing the energy richness and distribution within a subterranean energy-bearing formation comprising the steps of:

first, introducing into a borehole penetrating said formation a fluid material which will prevent premature combustions near said borehole;

second, introducing into said borehole an oxidant selected from the group consisting of an oxygen-containing gas, an oxygen-containing cryogenic liquid, and a water/oxygen slurry, said first introducing step effective to delay the combustion resulting from said introducing step such that said combustion occurs deeper into the formation; and recording at one or more locations any subsequent seismic activity due to said injection, the size and distribution the seismic event reflecting the energy richness and energy distribution of the formation.

17. The method of claim 16 wherein the oxygen content of said oxygen fluid is varied during the introduction thereof.

* * * * *